US005085358A

United States Patent [19]

Lam

[11] Patent Number: 5,085,358

[45] Date of Patent: Feb. 4, 1992

[54] ADJUSTABLE CLOTHES HANGER

[76] Inventor: Peter Ar-Fu Lam, 18C Block 3, Hong Kong Garden, Castle Peak Road, Tsing Lung Tau, N.T., Hong Kong, Hong Kong

[21] Appl. No.: 595,544

[22] Filed: Oct. 11, 1990

[51] Int. Cl.[5] ..... A47G 25/44; A47G 25/20; A47G 25/14

[52] U.S. Cl. ..... 223/94; 223/89; 223/88; 223/92; D6/324

[58] Field of Search ..... 223/94, 89, 88, 85, 223/95; D6/315, 324, 318; 211/113

[56] References Cited

U.S. PATENT DOCUMENTS

| | | | |
|---|---|---|---|
| 923,786 | 6/1909 | Geraci | 223/94 |
| 2,436,314 | 2/1948 | Lesavoy | 223/89 |
| 2,494,711 | 1/1950 | Kusher et al. | 223/94 |
| 2,504,562 | 4/1950 | Melcher | 223/89 |
| 2,589,374 | 3/1952 | Hannon | 223/89 |
| 2,679,958 | 6/1954 | Massa et al. | 223/89 |
| 2,716,512 | 8/1955 | Needles | 223/89 |
| 2,724,533 | 11/1955 | Hansen | 223/94 |
| 2,900,117 | 8/1959 | Veltry | 223/94 |
| 2,944,711 | 7/1960 | Sage | 223/94 |
| 3,039,662 | 6/1962 | Strong | 223/89 |
| 4,905,877 | 3/1990 | Gatling | 223/94 |

FOREIGN PATENT DOCUMENTS

| | | | |
|---|---|---|---|
| 203175 | 10/1958 | Austria | 223/89 |
| 1204121 | 1/1960 | France | 223/89 |
| 1228075 | 3/1960 | France | 223/89 |
| 887020 | 4/1959 | Switzerland | 52/5 |

*Primary Examiner*—Werner H. Schroeder
*Assistant Examiner*—Bibhu Mohanty
*Attorney, Agent, or Firm*—Lawrence S. Cohen; Arthur Freilich

[57] ABSTRACT

A clothes hanger in which each hanger arm is adjustable in length by means of an extender arm mounted for pivoting and sliding movement along a support arm. The support arm and the extender arm each have locator elements which co-act to hold the extender arm in a selected position on the support arm. The extender arm can be pivoted to disengage the locator elements and free the extender arm to permit it to slide to a new selected position; and then pivoted in reverse direction to re-engage the locator elements. Therefore, the effective length of the hanger arm can be selected and varied as desired.

17 Claims, 2 Drawing Sheets

FIG. 1
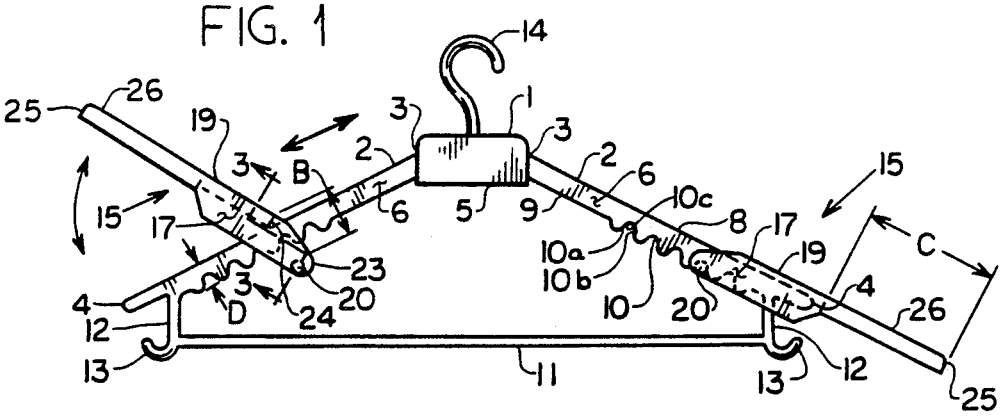
FIG. 1A
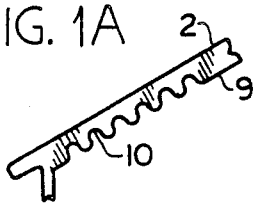
FIG. 2A
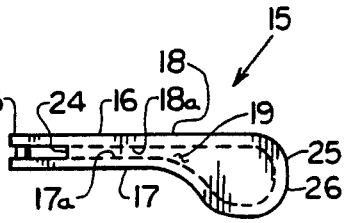
FIG. 2B
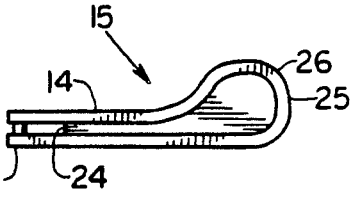
FIG. 3
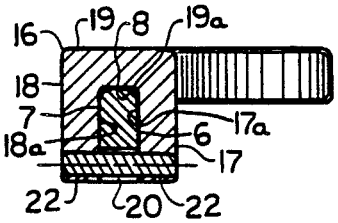
FIG. 4
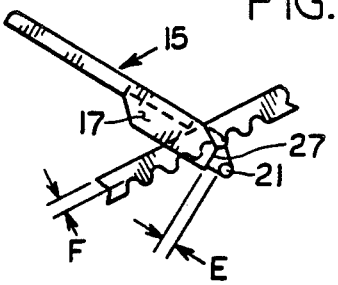
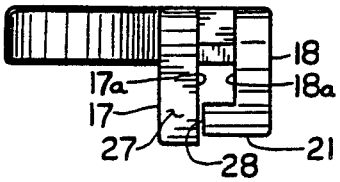
FIG. 5

ADJUSTABLE CLOTHES HANGER

BACKGROUND

This invention relates to clothes hangers. In particular, it relates to clothes hangers of the type in which the hanger arms for supporting a clothes item are adjustable in length.

Clothes hangers of fixed construction have the disadvantage that clothing of different styles and shapes and sizes do not all fit on the hanger equally well. As a result, clothes which are misfit to the shape or size of the hanger, hang in a deformed manner which causes wrinkling and misshaping of the cloth. The following are exemplary of the prior art; U.S. Pat. Nos. 923,786; 2,436,314, 2,494,711; 2,504,562; 2,679,958, 2,716,512; 2,900,117; 2,944,711; 3,039,662; 3,874,572 and 4,717,053 and United Kingdom Patent 887,020.

SUMMARY OF THE INVENTION

The present invention is an adjustable clothes hanger which permits adjustment of the length of the hanger arms in order to accommodate different shapes and sizes of clothing and to thereby permit smooth hanging of clothing. The present invention provides such an adjustable length clothes hanger which is inexpensive to make, easy to adjust, of rugged construction, and which provides a wide range of variation in size.

The invention provides a hanger with two support arms upon each of which are fitted an extender arm. The extender arm can be fixed in aligned and longitudinal position by a locator element on the extender arm which co-acts with one of a series of locator elements on the support arm. The extender arm is to be pivoted to disengage the locator elements; and then slid along the support to a new position, and reverse pivoted to engage the locator elements.

In a preferred embodiment of the present invention, the hanger arms which extend outwardly and downwardly sloped from a central hanging point can be adjusted in length. The adjustment is accomplished by providing a hanger arm which comprises an extender arm fitted onto a fixed length support arm. The extender arm can be moved and set in a number of available positions so that the overall length of the hanger arm is chosen to suit the item of clothing. The extender arm is allowed to move along the length of the support arm by means of mating surfaces on the support arm and extender member respectively. The extender arm is set in a selected position by a protrusion in the extender arm resting in a selected one of a series of recesses extending along the length of the support arm. The extender arm is disengaged from a position by pivoting it so that the protrusion rotates out of the recess.

When moved to the new location, the extender arm is pivoted in the opposite direction to rotate the protrusion into the selected, available recess. The protrusion when set in the recess prevents further rotation of the extender arm as well as any longitudinal movement, thereby fixing its position. The extender arm is formed of two parallel rigid walls, spaced apart to straddle the support arm. The protrusion is preferably a locking pin which extends laterally across the space between the walls, being attached to each wall.

In another embodiment, the locking pin extends from one wall across the space, and the opposite wall terminates short of the locking pin. This latter embodiment permits the extender member to be installed on and removed from the hanger without any disassembly. This will permit the hanger to be molded of three parts, a main body and two extender arms.

The novel features of the invention are stated with particularity in the claims. The invention will be best understood when the detailed description is read in conjunction with the drawings.

BRIEF DESCRIPTION OF THE DRAWINGS

FIG. 1 shows a front view of a first embodiment of the invention.

FIG. 1*a* shows an alternative construction of the support arm.

FIG. 2*a* shows a top view of the extender arm of the embodiment of FIG. 1.

FIG. 2*b* shows a bottom view of the extender arm of the embodiment of FIG. 1.

FIG. 3 shows a section view through 3—3 of FIG. 1.

FIG. 4 shows a partial front view of a second embodiment of the invention, with the extender arm shown in an up-pivoted position.

FIG. 5 shows an end view of the extender arm of the embodiment of FIG. 4.

DETAILED DESCRIPTION THE DEVICE

Figure 6:
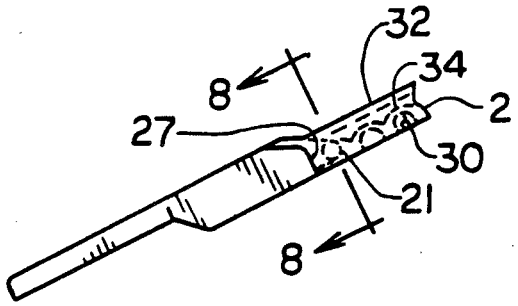
FIG. 6 shows a partial front view of an embodiment of the invention similar to that of FIGS. 4 and 5 but with a different construction of the support arm while using the extender arm of FIGS. 4 and 5, with the extender arm in the down-pivoted position.

With reference to FIGS. 1 through 3, a clothes hanger body 1 in accordance with the present invention includes elongated support arms 2 each having inner ends 3 and outer ends 4. The support arm inner ends 3 are mounted proximate to one another as by a junction bracket 5 with the support arms diverging symmetrically therefrom by an included angle of approximately 150 degrees. Each support arm is basically rectangular in cross section defining parallel front and rear surfaces 6 and 7 respectively and top and bottom surfaces 8 and 9 respectively. Locator elements comprising a series of recesses 10 are formed in the bottom surface 9 extending along the length of each support arm. A cross bar 11 extends generally between the outer ends 4, being attached thereto by transition members 12 Also at each end of the cross bar 11 is a hook 13. Placed centrally atop the junction bracket 5 is a suspension member, in this case a hook 14.

The front surface 6, rear surface 7, top surface 8, and bottom surface 9 extend along the length of the support arm between the inner end 3 and the outer end 4 except for interruption of the bottom surface 9 by interposition of the recesses 10 as now to be described. The recesses 10 are downwardly open formed by walls having three segments, opposed lateral segments 10*a* and 10*b* and an upper segment 10*c*. As shown all of these segments are smoothly joined curves; but they could be discretely segmented such as flat, and joined at corners. The size of the recesses 10 and in particular the space between lateral segments 10*a* and 10*b*, as will be apparent, is based on a determination of how finely it is desired to adjust the length of the hanger arms, that is, the effective hanger length provided by the combination of the support arm 6 and the extender arm 15. Smaller recesses 10 will allow finer adjustment and larger recesses 10 allow coarser adjustment. The length of the series of recesses 10 between the inner end 3 and outer ends 4 of the support arm 2 is determined by the length of the extender arm 15 and the desired fully extended effective length of the hanger arm as will be described below. The depth of the recesses 10 is chosen to provide secure positioning as well as straight alignment of the extender arm 15 on the support arm 2 as will also be described below.

FIG. 1*a* shows an alternative construction of the support arm 2. In this construction, the bottom surface 9 is lowered to be even with the entry of the recesses 10, rather than being set back as in FIG. 1.

As shown in FIGS. 1 through 3, the extender arm 15 has a body portion 16 of U-shaped cross section downwardly open, formed from a front side wall 17 and a rear side wall 18 and a top wall 19, which present opposed inner side surfaces 17*a* and 18*a* and a top inner surface 19*a* defining a channel for slidably and pivotally interfitting with the parallel front surface 6, rear surface 7, and the top surface 8 respectively of the support arm 2. The extender arm 15 has a locator element comprising a locking pin 20 pressed into holes 22 in the walls 17 and 18 which extends laterally across the channel defined by the inner side surfaces 17*a* and 18*a*, and is located at an inner end 23 of the extender arm 14. Also, the top wall 19 terminates at a terminal surface 24 which is longitudinally further toward an outer end 25 of the extender arm 3. This structure leaves a space shown at "B", which permits pivoting of the extender arm 15 as seen on the left side of FIG. 1.

The extender arm 15 is also equipped with a shoulder pad 26 which is shaped to support the shoulder of an item of clothing.

The extender arm 15 is preferably formed of molded rigid plastic, as is the clothes hanger body 2. While in the above described structure, the locking pin 20 is pressed into the holes 22 in the body portion 16 of the extender arm 15, the entire extender arm 15, including the locking pin 20, could be constructed of one piece of molded plastic. In order to enable assembly of a one piece extender arm 15 of this configuration onto the support arm 2, the support arm 6 would have to be open, such as by omitting the transition member 12 and the cross bar 11.

In operation, as seen on the right side in FIG. 1 the extender arm 15 extends beyond the outer terminal end 4 of the support arm 2 thereby providing an extended effective length "C" of the hanger arm for supporting an item of clothing. The extender arm 15 is held in place by co-action of the locking pin 20 and the recess 10, which prevents longitudinal movement and upward pivoting of the extender arm 15. Contact of the top wall 19, that is its top inner surface 19*a*, with the top surface 8 of the support arm 2 prevents downward pivoting. Contact of the front side wall 17*a* and the rear side wall 18*a* with the front surface 6 and the rear surface 7 respectively of the support arm 2 prevents twisting of the extender arm 15. To change its position, the extender arm 15 is upward pivoted as shown on the left in FIG. 1 so that the locking pin 20, pivots out of the recess 10. Now the extender arm 15 can slide along the support arm 2 to a new selected point, and can then be down-pivoted so that the locking pin 20 rests in a new selected recess 10. A critical limit to this construction is that the distance "B" between the terminal surface 24 of the top wall 19 and the locking pin 20 must be at least slightly greater than the distance "D", the height of the support arm 15 in the area of the recesses 10, in order that it is possible to pivot the locking pin 21 clear of the recess 15.

The construction just described requires at least one separately constructed part in order to assemble the extender arm 15 onto the clothes hanger body 1. Preferably, the locking pin 20 would be made separately and pressed into holes 22 in the front side walls 17 and rear side wall 18 after mounting of the extender arm 15 onto the support arm 2.

A number of alternative constructions are possible, including allowing the clothes hanger body 1 to be made of one piece by omitting the transition number 12 and the cross bar 11, or by any construction which would have either the extender arm 15 openable and closeable after mounting, or similarly by having the clothes hanger body 1 openable and closeable to receive a one piece form of the extender arm 15.

Another embodiment of the extender arm 15 is illustrated in FIGS. 4 and 5. This embodiment allows solid one piece construction of both the extender arm 15 and the clothes hanger body 1. In this embodiment, the front side wall 17 of the extender arm 15 terminates at surface 27 leaving space "E" between the surface 27 and the locking pin 21. Note that the locking pin 21 extends from the rear surface 18*a* of the rear wall 18 laterally across the space terminating at 28 approximately flush with the plane of the front surface 17*a*. Therefore, if the space "E" is at least slightly greater than the distance from top surface 8 of the support arm 2, to the top wall segment 10*c* of the recess 10 (distance F in FIG. 4), then the extender arm 14 can be installed, and removed by a lateral movement when it is in its up-pivoted position. This embodiment can use the structure of the clothes hanger body 1 as above described.

Figure 7:
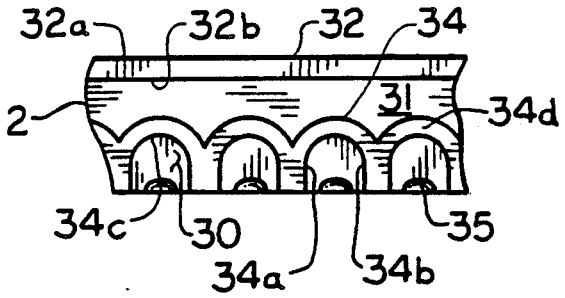
FIG. 7 shows a rear partial view of the support arm of FIG. 6.
Figure 8:
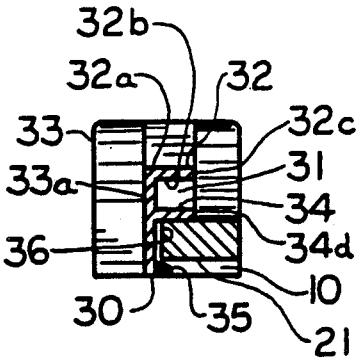
FIG. 8 shows a section view through 8—8 of FIG. 6.

In a further embodiment, when using the embodiment of the extender arm 15 as shown in FIGS. 4 and 5 (but with a slight modification), the support arm 2 can have the construction shown in FIGS. 6, 7 and 8. In this embodiment, the recesses 10 are blocked off at one side as by a wall segment 30. Therefore, the recesses 10 are open only on the rear side. Also, instead of the solid construction shown in the embodiment of FIGS. 1 through 5, in this embodiment, the material is omitted at 31 so that the top of the support arm 2 is defined by top wall 32, a side wall 33 and recess walls 34. The top wall 32 has an upper surface 32*a*, a lower surface 32*b* and an open end surface 32*c*. The side wall 33 extends the height of the support arm 2 comprehending also the wall segment 30. The recesses 10 are defined by the wall 34, specifically, lateral wall segments 34*a* and 34*b* and upper wall segments 34*c*. This also defines an end 34*d*. This open structure provides a lighter, less costly construction. Also, a tactile detent stud 35 is provided at the open end of each recess. In operation, this embodiment is first assembled by maneuvering the extender arm 15 over the support arm 2, in the up-pivoted position moving it lateral into position. In this embodiment, the locking pin 20 terminates at 36, inside the recess 10. Then it is used in the same manner as described above. The surfaces 33*a*, 32*c*, and 34*d* co-act with surfaces 17*a* and 18*a* of the extender arm 3 to prevent twisting. The tactile detent stud 35 gives a good tactile response as the extender arm is down-pivoted into position, when the terminal surface 24 of the locking pin 20 moves by it. Also, the tactile detent stud 35 prevents inadvertent up-pivoting which could occur when clothes are removed if there is no way to keep the extender arm 14 in its operative position.

The foregoing embodiments are exemplary of the means available to practice the present invention. Equivalent constructions within the scope of the appended claims may be devised by persons skilled in the art.

I claim:

1. A clothes hanger comprising:

a suspension member;

first and second elongated support arms extending symmetrically from near said suspension member, said support arms each having a first end proximate to said suspension member and a second end distal from said suspension member;

first and second extender arms respectively supported on said first and second support arms;

each extender arm having an inner terminal end toward the suspension member and an outer terminal end away from the suspension members; and a locator element on each extender arm engageable to any one of a series of aligned mating locator elements on its respective support arm for fixing the position of the extender arm in aligned relationship with the support arm at a preselected position to present an effectively continuous clothing support which is adjustable in length for an item of clothing;

each extender arm and its respective support arm having cooperative means for allowing pivoting in a given direction of the extender arm out of alignment with the support arm such that upon pivoting the locator element of the extender arm will move out of engagement with the mating locator element of the support arm and upon reverse pivoting into alignment the locator element of the extender arm will move into engagement with a mating locator element of the support arm; and the extender arm and the support arm being adapted for allowing axial sliding movement of the extender arm along the support arm when in the said pivoted position to permit locating the locator element of the extender arm is position for engagement with any selected locator element of the support arm upon reverse pivoting into the aligned relationship of the support arm and the extender arm;

each extender arm inner terminal end having first and second spaced parallel side walls, extending along opposite sides of the support arm, the second one of said side walls terminating at its inner terminal end a distance short of the point of termination of the first one of said side walls at its inner terminal end thereby defining an opening whereby upon pivoting the extender arm, the opening may be aligned with the height of the support arm permitting the extender arm to be assembled onto or disassembled from the support arm by lateral movement therebetween.

2. The clothes hanger of claim 1 in which the locator element of each extender member is a laterally extending protrusion from the first sidewall of the extender member and the locator elements of the support arm are a series of aligned recesses extending laterally of the support arm, whereby the protrusion may enter into any selected one of the recesses for setting the position of the extender member relative to the support arm and the opening for permitting lateral movement is between said second side wall and said protrusion.

3. The clothing hanger of claim 2 in which the recesses of the support arm have walls for preventing upward and longitudinal movement of the protrusion received therein, when the hanger is in clothes hanging orientation, and are open downwardly, and the extender member is pivotally fitted to the support arm by at least one of said side walls co-acting with a mating side surface of the support arm for upwardly pivoting of its outer terminal end and downwardly pivoting of its inner terminal end thereby defining upwardly pivoting of the extender arm; and the extender member further having a top surface co-acting with a top surface of the support arm to limit downward pivotal movement;

whereby the top surface and the protrusion co-act in contact with the top of the support arm and the walls of the recess respectively to fix the extender member in aligned position on the support arm against downward pivotal movement and the extender member may be upwardly pivoted to release the protrusion from the recess to allow the extender member to be moved to another selected position.

4. The clothing hanger of claim 3 in which the recess walls are an upper wall and longitudinally spaced side walls extending laterally across the support arm whereby the recesses are open at the bottom and sides of the support arm.

5. The clothing hanger of claim 4 whereby a detent extends into the recess from one of the side walls of the recess to provide tactile response to seating of the protrusion in the recess and to retain the protrusion in the recess against unintended dislodgement.

6. The clothing hanger of claim 3 wherein one side surface of the support arm extends across the recesses whereby the recesses are closed at one side and open at the other side and the protrusion extends from the extender arm from the side on which the recesses are open.

7. The clothing hanger of claim 6 further comprising a detent extending from the closed one side of the recesses into tactile interference with the protrusion on the extender member as it moves into and out of the recess.

8. The clothing hanger of claim 5 further comprising a pad member attached to each extender arm at its distal end, the pad member presenting a clothing supporting surface.

9. The clothes hanger of claim 1 wherein the locator element of each extender member is a protrusion extending from the first sidewall of the extender member and the opening for permitting lateral movement is between said second side wall and said protrusion.

10. The clothes hanger of claim 1 wherein the locator elements of the support arm are downwardly open recesses.

11. The clothes hanger of claim 10 wherein the recesses are also closed on at least one lateral side.

12. A clothing hanger comprising a suspension member extending upwardly from a central joining area;

a pair of support arms extending from the central joining area at an angle symmetrically downwardly away from the central joining area the support arms having a first end proximate to the central joining area and a second end distal from the central joining area defining therebetween a lengthwise axis and having a generally rectangular cross section defined by an upper surface and outwardly facing side surfaces and a lower surface and having interposed in the lower surface, walls defining an axial row of recesses which are downwardly open and extend laterally across the support arms being open at each side;

an extender arm on each support arm having an elongate body portion extending from an outer terminal end away from the central joining area to an inner terminal end toward the central joining area, the body portion formed of a top and spaced parallel first and second side walls defining a channel of rectangular cross-section for receiving therein the support arm and the top wall terminating at a first point toward the central joining area and the first side wall extending further toward the central joining area than the termination of the top wall and said first side wall having a protrusion extending across the channel from a lower area of the said first side wall from a point closer to the central joining area than the termination of the top wall thereby defining a pivoting space between the protrusion and the termination of the top wall and the protrusion extending across the channel into a selected one of the recesses;

and the second side wall extending a lesser distance toward the central joining area than the first side wall defining a side space between the terminal end of the second side wall and the protrusion, the side space having a dimension to allow the extension arm to be assembled onto the support arm by the support arm entering the side space by lateral movement.

13. The clothing hanger of claim 12 further comprising a pad member attached to each extender arm at its distal end, the pad member presenting a clothing-supporting surface.

14. A clothes hanger comprising:

a suspension member;

first and second elongated support arms extending symmetrically from near said suspension member, said support arms each having a first end proximate to said suspension member and a second end distal from said suspension member;

first and second extender arms respectively supported on and generally aligned with said first and second support arms when in a clothes hanging position each extender arm having an inner terminal end toward the suspension member and an outer terminal end away from the suspension members and being pivotable by upward pivotal movement of the outer terminal end and downward pivotal movement of the inner terminal end thereby defining upward pivotal movement and being moveable along the support arm when the extender arm is in the upward pivoted position; and a locator element on each extender arm near its inner terminal end engageable to any one of a series of aligned downwardly open spaced apart recesses whereby the locator element may enter into any selected one of the recesses from below said recess for setting the position of the extender member relative to the support arm; and the recesses of the support arm having walls for preventing upward and longitudinal movement of the locator element received therein, when the hanger is in clothes hanging orientation and said recesses being closed by a integral wall on at least one lateral side of the support arm.

15. The clothes hanger of claim 14 each extender arm further comprising first and second spaced side walls on opposite sides of each support arm and the locator element comprising a protrusion extending from the first side wall of each extender arm whereby the protrusion may enter into any selected one of the recesses for setting the position of the extender member relative to the support arm and said recesses are closed at least on a lateral side of the support arm opposite the first side wall from which the protrusion extends.

16. The clothes hanger of claim 15 further comprising a detent element inside each recess to interfere with entry of the protrusion in order to provide tactile response to positioning of the protrusion in the recess.

17. The clothes hanger of claim 16 in which the second side wall terminates at its inner terminal end short of the protrusion on the first side wall thereby defining a space between them sufficient to permit lateral movement of the extender member into and out of operable position when in the upwardly pivoted position.

* * * * *